United States Patent [19]

Goel et al.

[11] 3,976,370

[45] Aug. 24, 1976

[54] BELT TRANSFER AND FUSING SYSTEM

[75] Inventors: Narendra S. Goel, Henrietta; Gerald M. Fletcher, Pittsford, both of N.Y.

[73] Assignee: Xerox Corporation, Stamford, Conn.

[22] Filed: Mar. 28, 1974

[21] Appl. No.: 455,684

Related U.S. Application Data

[63] Continuation-in-part of Ser. No. 421,177, Dec. 3, 1973, Pat. No. 3,832,053.

[52] U.S. Cl. ..... 355/3 R

[51] Int. Cl.[2] ..... G03G 15/00

[58] Field of Search ..... 355/3

[56] References Cited

UNITED STATES PATENTS 3,649,114 3/1972 Vlach ..... 355/3

3,671,118 6/1972 Fantuzzo ..... 355/3

*Primary Examiner*—John M. Horan

[57] ABSTRACT

An electrostatographic copying system in which an image is formed on an imaging surface and transferred at a transfer station to a copy sheet, where the copy sheet is transported through the toner transfer station on a belt which has a pattern of very closely spaced discrete conductive strips which are electrically biased to provide a pattern of electrostatic fringe fields holding the sheet onto the belt. The same conductors may be variably biased in the transfer station to effect tailored transfer fields. The same belt then carries the sheet through the toner fusing station. The copy sheet may thus be continuously carried on the same supporting belt through the entire copying system.

19 Claims, 7 Drawing Figures

FIG. 1
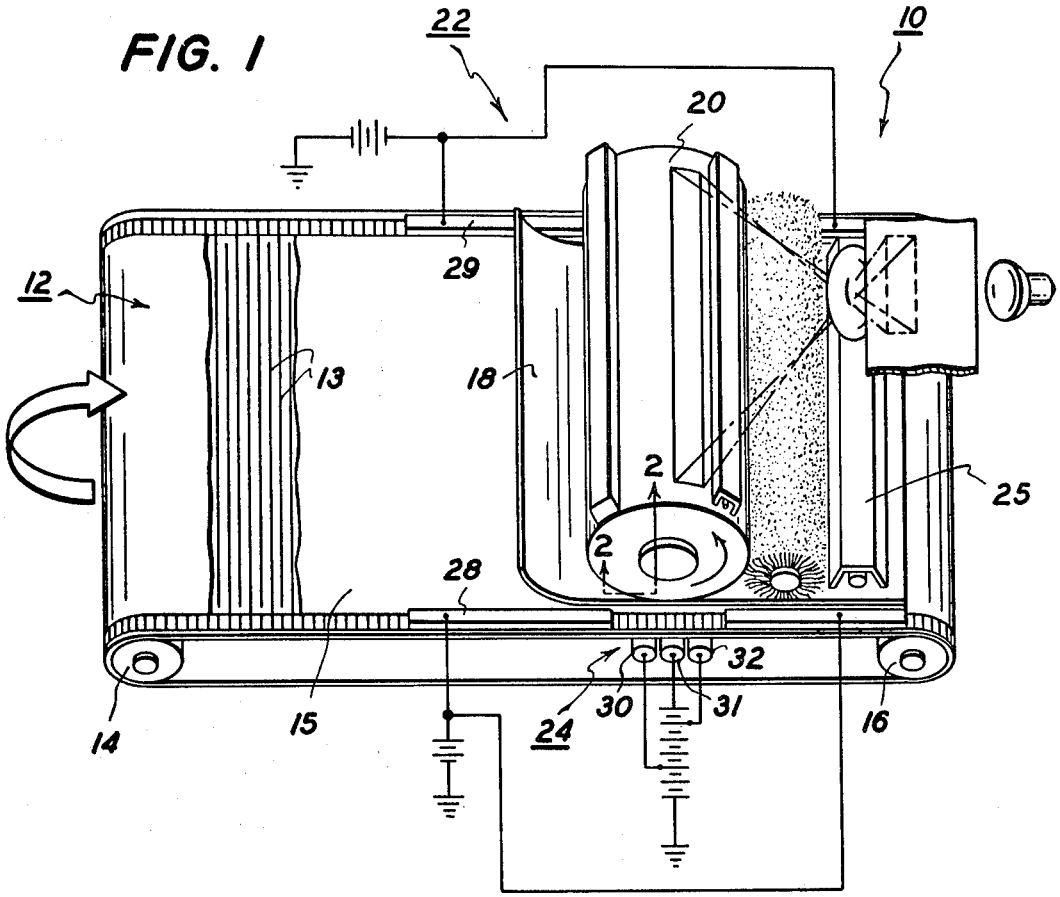
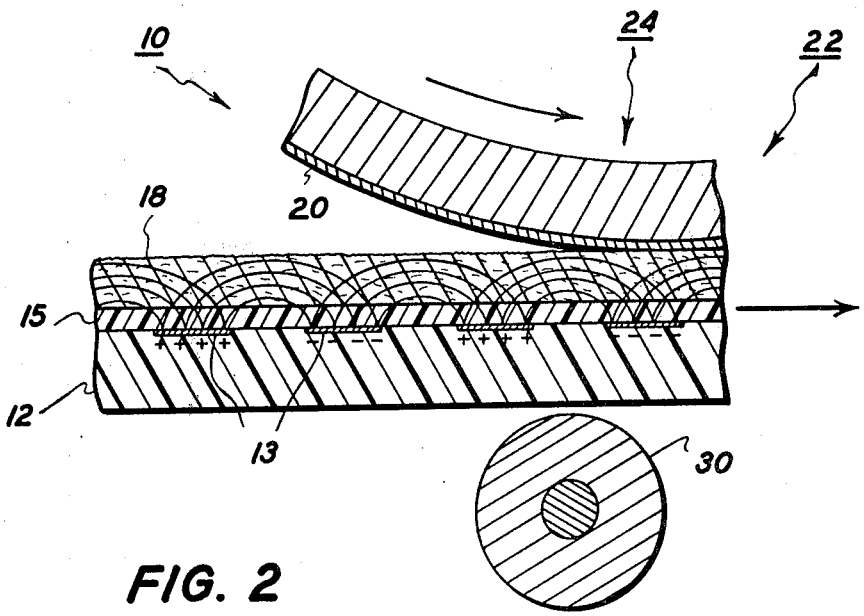
FIG. 2

FIG. 3
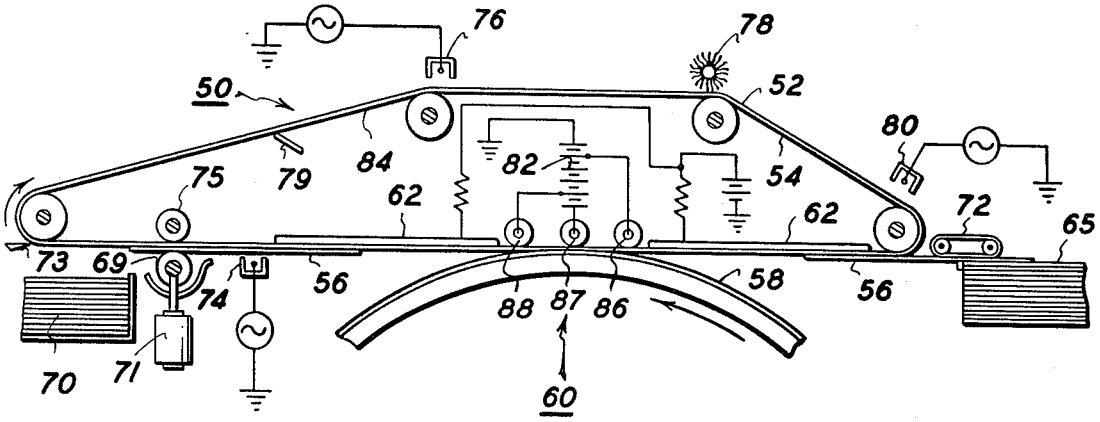
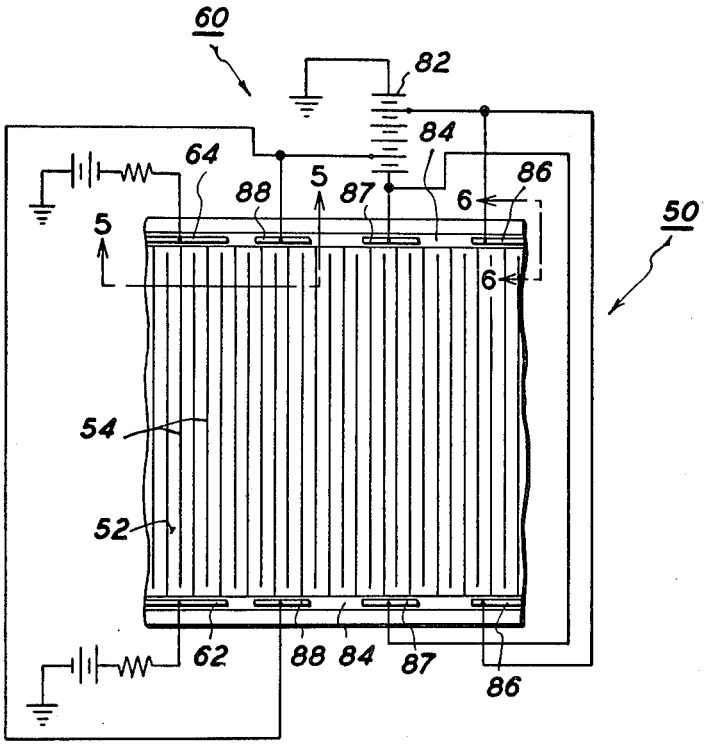
FIG. 4

BELT TRANSFER AND FUSING SYSTEM

This is a Continuation-In-Part of U.S. Pat. No. 3,832,053, issued Aug. 27, 1974, Ser. No. 421,177, filed Dec. 3, 1973, by the same inventors.

The present invention relates to an electrostatographic copying system in which the copy sheets are transported on a belt through both the transfer and fusing sub-systems for improved sheet handling and reliability.

The accurate and reliable transport of copy sheets, particularly cut paper, through the work stations of electrostatographic copying systems is a particular problem due to the highly variable nature of such materials. "Paper jams" are one of the main causes of copying machine shut-downs. Various sheet transporting devices, such as mechanical grippers, vacuum and other transport belts, feed rollers, wire guides, charged photoreceptors, etc., are well known. Generally several different transport systems are utilized, and the sheets must be transferred between them. Each such sheet transfer adds a potential jam area, especially if the sheet has a pre-set curl. Both the transfer and fusing work stations have particular sheet handling problems because of electrical and thermal and pressure effects on the sheet.

It is generally known that a copy sheet can be transported on a belt or other member on which it is held by an electrostatic charge pattern. The following U.S. Pat. Nos. are exemplary of this art: 2,576,882 to P. Koole et al.; 3,357,325 to R. H. Eichorn; 3,642,362 to D. Mueller; 3,690,646 to J. A. Kolivis; 3,717,801 to M. Silverberg; and 3,765,957 to J. Weigl (electrostatic original document detention is disclosed in 3,194,131 and 3,634,740). The general concept of belts with alternating charged areas is suggested in these references, but not sufficiently close spacing to prevent interference with image transfer or the belt system disclosed herein.

In a conventional transfer station in electrostatography, toner (image developer material) is transferred from the photoreceptor (the original support and imaging surface) to the copy paper (the final support surface). The toner is then fixed to the copy sheet, typically in a subsequent thermal fusing station.

In xerography, developer transfer is most commonly achieved by electrostatic force fields created by D.C. charges applied to the back of the copy paper (opposite from the side contacting the toner-bearing photoreceptor) sufficient to overcome the charges holding the toner to the photoreceptor and to attract most of the toner to transfer over onto the paper. These xerographic transfer fields are generally provided in one of two ways, by ion emission from a transfer corotron onto the paper, or by a D.C. biased transfer roller or belt rolling along the back of the paper. Examples of bias roller transfer systems are described in U.S. Pat. No. 3,781,105, issued Dec. 25, 1973 to Thomas Meagher, and in U.S. Pat. Nos. 2,807,233; 3,043,684; 3,267,840; 3,328,193; 3,598,580; 3,625,146; 3,630,591; 3,691,993; 3,702,482; and 3,684,364. U.S. Pat. No. 3,328,193 discloses a transfer system with spaced multiple rollers at different biases.

A particular copy sheet transport problem is the accurate and positive transporting of sheets into, through, and out of a xerographic or other electrostatographic transfer station. The copy sheet must be maintained in accurate registration with the toner image to be transferred. The transfer electrostatic fields and transfer contact pressure are critical for good transferred image quality. Further, the sheet typically acquires a tacking charge and the imaging surface has a charge on it as well. Thus, the copy sheet must be either mechanically or electrostatically stripped (separated) from the imaging surface at the exit of the transfer station or process, yet without disrupting the transferred image which is typically unfused at that point and easily disturbed by either mechanical or electrical forces.

It may be seen that it is desirable to fully support and positively retain the copy sheet on the same transport through the entire transfer station, particularly including the removal of the sheet from the imaging surface. The present invention provides electrostatic means for continuously positively retaining a copy sheet, including its passage through a transfer station, on a single moving belt surface. Thus, the present system does not require a vacuum sheet retaining system, although it will be appreciated that a vacuum may be additionally applied in combination therewith if so desired.

Considering particularly references to prior transfer belt systems, U.S. Pat. No. 3,332,328, issued July 25, 1967, to C. F. Roth, Jr., discloses a xerographic transfer station including an endless loop belt for carrying the copy sheets through the transfer station, including contact with the xerographic drum, and corona charging means for placing a transfer charge on the back of the endless transfer belt.

U.S. Pat. No. 3,357,325, issued Dec. 12, 1967, to R. H. Eichorn et al., also contains these same basic features, plus additional D.C. corona charging means to charge the sheet of copy paper on the belt prior to transfer, so as to hold the paper on the belt electrostatically. It should be noted, however, that the charging of the paper (or belt) in this manner contributes to the total transfer potential, which is generally undesirable unless this additional charge can be held constant. A transfer corona generator is tilted relative to the back of the belt to provide the Eichorn transfer field.

U.S. Pat. No. 3,647,292, issued Mar. 7, 1972, to D. J. Weikel, Jr., discloses a uniform transfer belt system for carrying a copy sheet through the transfer station, vacuum means for holding the sheet on the belt, and transfer field generating means, which in one embodiment includes multiple stationary transfer electrodes in a stationary segmented plate with different (increasing) applied potentials acting at the back of the transfer belt. This reference is, therefore, particularly relevant to the present invention.

U.S. Pat. No. 3,644,034, issued Feb. 22, 1972, to R. L. Nelson discloses a segmented wide conductive strip transfer belt to which two different bias potentials are applied by two support rollers to those segments passing over the rollers. The conductive segments are separated by 1/16 inch insulative segments.

The most desirable aspects of a transfer system are high transfer efficiency with no image defects and high reliability, including insensitivity to external machine variables (relative humidity, paper type, etc.) where both are achieved with minimal complexity and cost. As noted, an important aspect of reliability associated with the transfer system is reliable paper handling. This must include good paper-to-photoconductor contact before application of an electric field sufficient for transfer. A bias belt transfer system offers the possibility of a reliable paper handling system with high transfer efficiency and less image defects. A belt transfer system for the present invention can take many different forms and path configurations, as long as it is a belt to which the paper is tacked reliably and is carried thereon through the transfer system and eventually on to, and through the fusing system, without separating from the belt. The transfer can be achieved by various methods and structures.

The belt can provide the optimum geometry that will cause stripping of the paper away from the photoconductor after transfer, thus reducing the transfer stripping interactions that can occur in conventional corona or bias roll transfer systems. Similar advantages can be provided for the fusing station. Belt transport into the transfer and fusing regions can also remove the criticality of the paper lead-in configuration and problems due to lead-edge curl. Continuous sheet transport in and through the transfer and fusing regions on the belt minimizes the chance of defects due to speed mismatch. The problem of insuring good paper-to-photoreceptor contact with thick papers and small photoconductor radii in corona transfer systems is eliminated in belt systems since it is only required to tack the paper to the infinite radius (substantially flat) belt, not the photoconductor. Further, lower nip pressures may be designed with more flexibility than with a bias roller transfer system. Subsequent stripping of the copy sheet from the belt can be accomplished by using a sharp exit path radius; e.g., running the belt around a small radius roller, to make use of the inherent beam strength self-stripping action of the copy sheet.

In addition to paper transport gains, a belt transfer system offers potential special features. Among them are: simultaneous duplex, by initial toner image transfer to the belt and then reversing the charge of the toner (by corona treatment) before the next transfer pass; carrying paper directly to or through the fuser; and image preservation, i.e., multiple copies from the same latent image.

The difficulties of successful image transfer are well known. In the pretransfer (pre-nip) region, before the copy paper contacts the image, if the transfer fields are high the image is susceptible to transfer across the air gap, leading to decreased resolution and, in general, to fuzzy images. Further, if there is pre-nip ionization, it may lead to strobing defects, loss of transfer efficiency, of "splotchy" transfer and lower latitude of system operation. In the post-nip region, at the photoconductor-paper separation area, if the transfer fields are low (say, less than approximately 12 volts per micron for lines and 6 volts per micron for solid areas) hollow characters may be generated, especially with smooth papers, high toner pile heights and high nip pressures (greater than approximately 1 pound per square inch). On the other hand, if the fields in the post-nip region are improper, the resulting ionization may cause image instability and paper detaching from the belt. In the nip region itself, to achieve high transfer efficiency and "permanent" transfer, the transfer field should be as large as possible (greater than approximately 20 volts per micron). To achieve these different fields in adjacent regions consistently and with appropriate transitions is difficult.

It will be noted that the use of a fine charge pattern produced on the imaging surface itself, for increased toner retention by fringe field effects, e.g., for improved "half-tone" solid area image reproduction, is known. The fine charge pattern may be placed on the photoreceptor imaging surface by an optical screen, or by the photoreceptor construction itself, or by contact with a charging roller having a patterned or textured surface for transferring a fine electrical pattern to the photoreceptor. For example, the imaging surface may be pattern charged by a contacting electrically charged wire screen or knurled conducting rubber roller at a suitable voltage. However, this type of structure is utilized for increasing the quantity or uniformity of toner retained on a given area of the photoreceptor prior to its transfer to the copy sheet, and not for retention of a copy sheet. Thus, it affects the transfer by changing the image which is transferred. In contrast, the copy sheet transport system of the invention does not affect the imaging surface and does not affect the transfer process or the transferred image pattern.

The sheet transport system of the invention may be utilized in any desired path, orientation or configuration. It may be utilized for transfer with an imaging surface which has any desired configuration, such as a cylinder or a belt. Belt imaging surface photoconductors in electrographic copying systems are exemplified by U.S. Pat. Nos. 3,093,039 to Rheinfrank; 3,707,138 to Cartright, and 3,719,165 to Trachienberg, et al.

In order to permanently affix or fuse the electroscopic marking particles (toner) onto the final support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, various applications of thermal energy for fixing toner images onto a support member are old and well known, and exemplary structures need not be described in detail herein.

One commercially utilized approach to thermal fusing of electroscopic toner images onto a support is "roll fusing", in which the support, with the unfused toner images thereon, is passed between a pair of opposed roller members, at least one of which is generally internally heated and called the fuser roll. The opposed roller is called the pressure or back-up roll. During operation of a fusing system of this type, the support member to which the toner images are electrostatically adhered is moved through the nip formed between the rolls with the toner image contacting the fuser roll to thereby effect heating of the toner images within the nip. This type of fuser is illustrated in the embodiment of FIGS. 3 – 7 here. By controlling the heat transferred to the toner, the materials of the roller surfaces, and/or using lubricant materials, very little offset of the toner particles from the copy sheet to the fuser roll is experienced under normal conditions. The heat normally applied to the surface of the fusing roller is insufficient to raise its temperature above the "hot offset" temperature of the toner whereat the toner particles in the image areas of the toner would liquify and cause a shearing action in the molten toner to thereby result in "hot offset". Shearing occurs when the cohesive forces holding the viscous toner mass together is less than the adhesive forces tending to offset it to a contacting surface such as the fuser roll surface.

Occasionally, however, toner particles will be offset to the fuser roll by an insufficient application of heat to the surface thereof (i.e., "cold" offsetting); by imperfections in the properties of the surface of the roll; or by the toner particles insufficiently adhering to the copy sheet by the electrostatic forces which normally hold them there. In such a case, in a conventional roll fuser toner particles may be transferred to the surface of the fuser roll and subsequently transferred to the contacting backup roll during periods of time when no copy paper is in the nip. Moreover, toner particles can be picked up by the fuser and/or backup roll during fusing of duplex copies or simply from the surroundings of the reproducing apparatus.

Examples of roll fusing systems are disclosed in U.S. Pat. Nos. 3,268,251 and 3,256,002. Exemplary strippers for insuring that the sheet strips from the fuser rolls after fusing are disclosed in U.S. Pat. Nos. 3,357,401, and 3,519,253. The need for such strippers emphasizes the value of a system in which the sheets are retained on a transport belt through the fuser and thereby automatically stripped from the fuser rolls. Single roll fusers with corona charging means to hold the copy sheet to the fusing roller electrostatically are disclosed in U.S. Pat. Nos. 2,701,765, issued Feb. 8, 1955, and 3,519,253, issued July 7, 1970.

The disclosed system is also applicable to other fusing systems such as a flash fuser, or a radiant fuser as shown in FIG. 1. An exemplary patent for radiant fusers is U.S. Pat. No. 3,449,546.

Of particular prior art interest to the present application are fusers, roll or radiant, in which the copy sheet is transported through the fuser on a belt. These are taught in the following two references: British Pat. No. 1,322,354, published July 4, 1973 (XD 2171); and U.S. Pat. No. 3,578,797, issued May 18, 1971. Appropriate belt materials were disclosed therein, and also in U.S. Pat. No. 3,013,878, issued Dec. 19, 1961. In the latter patent, however, the image is developed and fused on the belt itself and then transferred to the copy sheet, which has obvious cleaning problems. In the two former patents the belt is a separate belt only for the fusing station and the copy sheet must be transferred thereto from other transport means.

The above-cited and other references teach details of various suitable exemplary xerographic structures, materials and functions to those skilled in the art. Further examples are disclosed in the books *Electrophotography* by R. M. Schaffert, and *Xerography and Related Processes* by John H. Dessauer and Harold E. Clark, both first published in 1965 by Focal Press Ltd., London, England. All references cited herein are incorporated in this specification, where appropriate.

Further objects, features and advantages of the present invention pertain to the particular apparatus, steps and details whereby the above-mentioned aspects of the invention are attained. Accordingly, the invention will be better understood by reference to the following description and to the drawings forming a part thereof, wherein:

FIG. 1 is a schematic perspective view of an exemplary belt transfer and fusing system in accordance with the present invention, in an otherwise conventional xerographic copying system, with part of the upper belt surface broken away to show the conductors therein:

FIG. 2 is a magnified cross-sectional view taken along the line 2—2 of FIG. 1;

FIG. 3 is another embodiment of the invention in a schematic side view;

FIG. 4 is a top view of the transfer station of FIG. 3;

Figure 5:
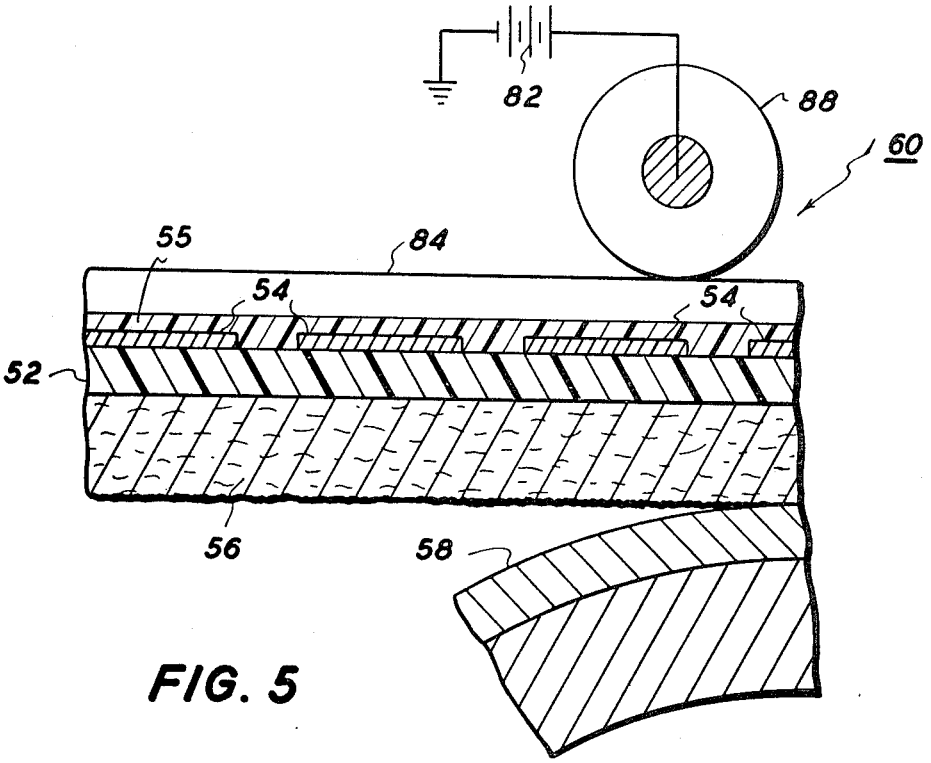
FIG. 5 is a magnified cross-sectional view taken along the line 5—5 of FIG. 4.

The embodiment of FIGS. 3–7 is preferred. Describing first, however, the other embodiment of FIGS. 1 and 2, there is schematically shown a belt transfer and fusing system 10 as an exemplary embodiment of the present invention. Since various details thereof are well known and fully described in the above-cited and other references relating to copy sheet handling, transfer, fusing and xerography in general, those conventional details, for improved clarity, will not be described herein.

The system 10 here comprises a copy sheet transport belt 12 which is supported and rotatably driven between rollers 14 and 16. The transport belt 12 is preferably constructed from a relatively thin and uniform conventional dielectric material such as 5 to 25 mil Mylar, (polyetheleneterethalate) for example. (An additional "relaxable" or semi-conductive backing layer may also be provided, as subsequently noted). The belt 12 has, over its upper surface, a very fine (closely adjacent) pattern of interdigitated conductive stripes 13 extending linearly perpendicular the direction of belt movement. These conductors 13 may be placed on the belt 12 by conventional flexible printed circuit techniques. The conductors 13 are preferably protectively overcoated by a thin dielectric layer 15 as shown. This outer layer 15 here is preferably white (reflective) to avoid heat pick-up from the radiant fuser. Teflon (tetrafluoroethylene) or Kel-F or high temperate resistant silicone rubber are appropriate materials.

The copy sheet transport belt 12 positively supports, holds and carries the copy sheet 18 into and out of contact with an imaging surface 20 of a xerographic copying system 22 at a transfer station 24, and then through a conventional radiant fuser 25. Transfer is provided here at the transfer station 24 by three differently biased transfer rollers extending uniformly under the belt in fixed positions. The xerographic copying system 22 shown here also schematically includes the conventional stations, in order, for cleaning, charging, optical imaging and toner development of the imaging surface 20.

The transport belt 12, by an electrostatic fringe field charge pattern generated by differentially biasing the conductors 13, provides positive retention of the copy sheet 18 at all desired points along the path of the transport belt 12, until it is desired to strip the copy sheet therefrom by any suitable conventional sheet stripping means. With the disclosed system the copy sheet 18 can be positively retained through the entire transfer station 24 without affecting the normal xerographic transfer in any way.

A highly desired feature of the electrostatic paper tacking pattern formed on the belt is that the adjacent conductive areas are sufficiently closely spaced, i.e., sufficiently fine, to form a very fine fringe field electrostatic pattern which will not affect the image transfer at the transfer station. Preferably the spacing between conductors is not substantially greater than the thickness of the copy sheet or not greater than the thickness of the copy sheet plus the intervening belt material thickness if that is substantial. Such close or fine spacing will cause the fringe fields to extend primarily inside the copy sheet from the supported back surface thereof, and not extend appreciably outside of the front, or image-receiving, surface of the copy sheet. Thus, they will not affect transfer. Note FIG. 2 in this regard. For most conventional copy sheet thicknesses the preferred conductor pattern is thus approximately 0.13 millimeters (5 mils) in spacing between the conductive areas, with comparable conductor area widths, which provides 40–50 parallel conductors per centimeter. With this spacing the fringe fields generated on the underlying transport belt 12 will not significantly affect the transfer fields in the transfer nip of the transfer station, and thereby will not affect the transfer of toner to the upper or exposed surface of the copy sheet 18. Further, they will not disturb the toner once it is transferred to the copy sheet. This substantially eliminates the chances for any observable toner "print-out" of the transport belt charge pattern onto the copy sheet.

It will be noted that the adjacent conductors of the transport belt 12 do not have to be biased to an opposite polarity. One can be grounded, or both can be of the same polarity, but different levels. For paper tacking it is only necessary that adjacent conductors be charged or discharged to a substantially different, i.e., higher or lower, voltage level than so as to create fringe fields of appropriate intensity for retention of the particular copy sheets.

For applying the desired tacking bias voltages to the conductors 13 in the belt 12, the conductors are divided into two interdigitated sets, that is, each alternating conductor (one set) is brought out to one side, and the other set is brought out to the other side or edge of the belt 12. This may be seen in the broken-away area of the belt of FIG. 1. For better contacts and wear resistance the conductors may take the form at each edge of an exposed strip of thicker conductive pads such as more heavily plated copper or gold. These pads, however, must be spaced from one another so that each individual conductor remains electrically discrete.

Since the alternating conductors 13 are thus provided with a line of contact pads moving linearly in an endless loop along with the rest of the belt surface, it may be seen that they may be easily electrically connected conventionally to any desired electrical bias source by any conventional sliding or rolling electrical contactor. This is illustrated in FIG. 1 by the extended linear bars or blocks 28 and 29 along opposite sides of the belt 12 which may be of copper, brass, carbon or other suitable contactor materials. The blocks 28 and 29 here apply opposite bias potentials to all of the conductors 13 thereunder, thus providing a copy sheet tacking field coextensive with their length over the belt surface between the blocks.

In the embodiment of FIG. 1 the belt 12 is desirably wider than the imaging surface 20. Thus, even though here the conductor contact pads and the engaging blocks 28 and 29 are on the copy sheet carrying side of the belt facing the imaging surface 20, the contact blocks 28 and 29 will not interfere with the imaging surface 20. The blocks 28 and 29 are interrupted (not present) in the transfer station 24 so that the conductors 13 are electrically floating there and will not form a Faraday shield blocking the transfer fields. However, the paper tacking charges already applied to the conductors will remain on them through transfer. Thus, copy sheet retaining fringe fields can be produced and maintained continuously on the belt 12 from the point where the copy sheet first engages the belt to the point after transfer where the copy sheet is to be stripped from the belt. Thus, the copy sheet is positively fully retained on the belt at all times, including transfer, yet without interference with the normal image transfer process.

Paper stripping and cleaning of the belt is preferably accomplished in uncharged areas of the belt, which can be provided wherever desired with the disclosed commutative belt structure. A grounding contact may be provided for the conductive pads in the desired stripping area to remove all tacking charges from the belt.

Considering now the transfer system of the embodiment of FIGS. 1 and 2, this is accomplished with three spaced apart and differently biased transfer electrodes 30, 31 and 32, which are respectively located under the belt 12 in the pre-nip, transfer nip and post-nip areas of the transfer station 24. The electrodes 30–32 are all mounted at a fixed distance from the imaging surface, basically determined by the thickness of the belt 12. Preferably they will ride against the back of the belt 12, although they may vary in spacing or contact with the belt 12 depending on the copy sheet presence and thickness. The electrodes are electrically insulated from the belt 12 here by the intervening dielectric backing of the belt.

The transfer electrodes 30–32 here are shown as conductive rollers. However, they may also be fixed electrodes of any desired configuration, for example, rods of a diameter of approximately 1 centimeter or less, but preferably not so small as to act as corona generators with the applied voltages. The electrodes 30–32 preferably have the same diameter extending fully transversely under the belt so as to provide transversely uniform fields.

As schematically illustrated, the electrical transfer biases applied to each electrode 30, 31 and 32 are from the same power source, but differ, so as to apply tailored (selectively varying) transfer field potentials to the imaging surface copy sheet interface as the copy sheet moves through the transfer station, i.e., along the belt path. The use of multiple transfer electrodes allows this to be accomplished without requiring the use of special electrically relaxable materials for the belt or the transfer electrodes. Typically, the voltage on the pre-nip electrode 30 may be only a few hundred volts, while the nip electrodes 31 may have approximately 5000 volts bias, and the post-nip electrode 32 a different bias again. A pre-nip field of less than approximately 2 volts per micron can be tolerated with a copy sheet to imaging surface air gap of greater than approximately 1 mil.

It will be appreciated, of course, that a different transfer system can be designed in which the transfer electrodes contact the back of the belt continuously, held thereagainst by a spring bias force or the like. They may be spaced along the belt by approximately one to one and a half centimeters, contacting a relaxable or resistive material layer overlying the back of the belt, which provides transfer field tailoring between electrodes. The same paper holding advantages of the present system may be provided by the use of the conductive pattern 13, since it will not interfere with any type of transfer system described herein.

Another desirable transfer electrode system for use with a transfer belt system is disclosed in U.S. Pat. No. 3,830,589, issued Aug. 20, 1974, Ser. No. 421,178, filed Dec. 3, 1973, by Walter C. Allen, commonly assigned, entitled "Conductive Block Transfer System".

Considering now the embodiment 50 of FIGS. 3–7, it may be seen that it has a belt 52 similar in construction and function to the belt 12 as described above. The pattern and spacing of the conductors 54 therein to achieve paper tacking fringe fields is preferably similar.

The system 50 differs in several respects, however. Here the lower surface of the belt carried the copy sheets 56 through engagement with the similar photoconductive imaging surface 58, and the pattern of conductors 54 here is on the opposite or upper surface of the belt. However, the arrangement of FIGS. 1 and 2 could also be utilized here instead. A principal distinction of the system 50 is that in the transfer station 60 here transfer is accomplished by a constant transfer charge tailored transfer field system in which the transfer bias voltages are commutatively applied to selected belt conductors 54 themselves by the transfer electrodes. Therefore, the transfer fields are created between those conductors 54 which are transfer biased and the imaging surface 58. These transfer biases may be applied to the conductors 54 by sliding or rolling (as shown) contacts at the edges of the belt in the transfer station 60.

The application of the paper tacking (fringe field generating) biases to opposite sides of the belt can be accomplished by sliding contacts 62 and 64 similarly to the blocks 28 and 29 of FIG. 1. However, as shown, these blocks 62 and 64 may be interrupted in the transfer station 60 so as to prevent conflicts with the transfer bias supplies. As previously noted, the belt preferably is wider than the imaging surface, and the contacts brought out to the edge of the belt so that all contacts can be made on either side of the belt. The arrangement of FIGS. 3–7, desirably allows unimpeded access to the transfer nip since all electrodes are located on the side of the belt opposite from the imaging surface. The belt conductors 54 may be on the back of the belt. Normally, however, as shown, a thin dielectric layer or coating 55 is applied over the conductors for protection and ease of cleaning except at the exposed contact pad (side strip) areas. The coating 55 and the belt material 52 may be similar to the layer 15 previously described for FIGS. 1 and 2. This coating is not shown in FIG. 4, for clarity in viewing the conductors 54.

Referring to the overall system 50 illustrated in FIG. 3, it may be seen that the belt 52 transports the copy sheets 56 without transfer from the input stack 65 to and through a conventional heated roll fuser 68 from which the sheets exit and are carried on by the belt to the output stack 70. The belt 52 is designed to carry the sheets right through the fuser 68.

A retard sheet feeder 72, as described in U.S. Pat. No. 3,768,804, issued Oct. 30, 1973, to K. K. Stange, for example, is shown feeding copy sheets, as defined in that patent, from the input stack 65 into registered contact with the belt 52. From there on the described electrostatic tacking forces hold the sheets in fixed positions on the belt surface until sheet stripping occurs at the sharp radius turn at the opposite end of the belt, which is preferably substantially downstream from the fuser 68 exit. An alternating current corona generator 74 may be positioned at or before this stripping area, acting on the copy paper to neutralize any charges on the paper, thereby aiding stripping and preventing Lichtenberg figures (toner disruptions from air breakdowns). This corotron 74, like a detack corotron, preferably has a high output current sensitivity to the surface voltage for preferential neutralization.

After the copy sheets 56 are stripped from the belt 52, the return loop of the belt may be used for cleaning and charge neutralizing of the belt. To prevent excessive toner build-up on the belt and to remove toner due to images transferred without paper moving through the transfer nip, the belt may be cleaned by one of the many standard cleaning systems, e.g., vacuum, brush, blade, web, biased fabric or magnetic brush. Due to low toner throughput, the requirements of the belt cleaning system are not as large as found in photoconductor (imaging surface) cleaning. Removal of transfer bias, or belt transfer contact, in non-image areas and no copy sheet conditions will reduce toner transfer to the belt surface. FIG. 3 illustrates a cleaning system comprising a conventional pre-clean (toner and belt neutralizing) corotron 76, followed by a conventional fabric cleaning roller or brush 78 cleaning the outer belt surface. This in turn is followed by a further belt surface charge neutralizing corotron 80 to remove any belt surface charges, which could add to or detract from the subsequently applied transfer fields. Although by proper choice of belt material cyclic surface charge build-up can be avoided, for long term and low humidity reliability such a belt neutralizer may be desirable. A conventional polyurethane or the like cleaning blade 79 is illustrated cleaning the inside surface of the belt, in the event random contamination makes this desirable.

For long term reliability it is desirable to provide belt lift mechanisms for lifting the belt away from the imaging surface 58 and the fuser rolls, or vice-versa, during the shutdown periods of the copier. This could be provided by a solenoid retracted intermediate belt roller by way of example. Moving the entire belt system away by an appropriate releasable mounting of the belt end rollers could also be provided. The fuser roll can be separated away from the belt and the pressure roll by various latching or solenoid means activated when the belt is stationary.

Figure 6:
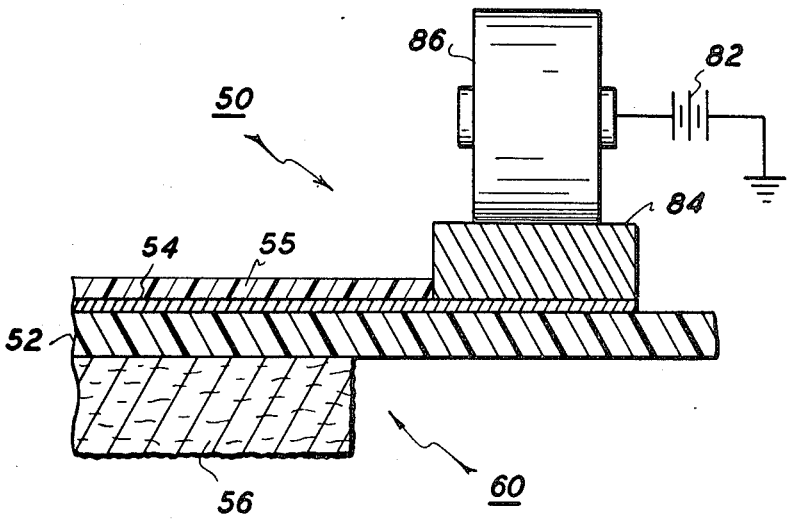
FIG. 6 is a magnified cross-sectional view taken along the line 6—6 of FIG. 4.

Referring to FIGS. 5 and 6, these are enlarged cross sectional views through the belt 52 and a copy sheet 56 thereon, along the lines 5—5 and 6—6 of FIG. 4. Thus, FIG. 5 is a cross sectional view along the longitudinal direction (of movement) of the belt at and beyond the post-nip area, while FIG. 6 is cross sectioned perpendicularly through the rear edge (side) of the belt. The thickness of the printed circuit conductive strips 54 is somewhat exaggerated relative to the belt thickness for clarity here.

An important consideration for the thickness of the belt 52 here is that since the conductors 54 are on the back of the belt, the dielectric material of the belt thickness is between these conductors and the imaging surface 58. Higher bias potentials on the conductors 54 are therefor needed for thicker belts in order to obtain the same transfer fields. A very high applied transfer voltage is undesirable, to avoid excessive air gap ionization occurring in pre or post-nip air gaps.

However, this problem can be avoided both by thinner belts and by belts with a greater dielectric constant. Thus, a 20 volts per micron transfer field can be achieved with an applied conductor potential of only 3000 volts with a belt having a dielectric constant of 5 and a thickness of 27 mils. Much thinner belts are practical with modern flexible dielectric materials. Of course, the conductors 54 do not have to be on the back of the belt, but can be sandwiched inside, closely adjacent the imaging surface, as previously noted.

Contact between a common transfer bias voltage potential source 82 and the conductors 54 in the transfer 60 could be accomplished by direct sliding or rolling electrical contacts. However, series resistance is desired to prevent ionization or arcing, both at the contacts themselves as the conductors make and break contact, and also possibly between adjacent conductors where a high potential difference exists. These problems are resolved here by a continuous thick strip of resistive material 84 commonly interconnecting and overlying the ends of the conductive strips 54 which extend to each edge of the belt. The resistive material is not critical. A suitable bulk resistivity is $10^6$ to $10^7$ ohm-centimeters. It should act as a short time constant (purely ohmic) conductor in the direction of belt movement, but not cause an excessive power drain between contactors. Here the contact with both the paper tacking and transfer bias sources is made through this resistive layer, which thereby functions as an additional high series resistance in the bias supply leads to prevent contact arcing problems and to protect the conductors from contact wear.

An even more important function of the strip of resistive material 84 is that it uniformly distributes the applied voltage between adjacent bias supply contacts evenly over all the intervening conductive strips, assuming the bias is applied evenly to both sides of the belt in the same transverse line. Thus, if the spacing along the side of the belt between two adjacent contacts on the resistive material 84 is 1 centimeter and there are 20 parallel conductors per centimeter, even a 5000 volt difference between the voltages applied by the two contacts will cause a voltage drop between conductors of only 250 volts, which is well below ionization potentials even for the closely spaced conductors 54.

Further, it will be noted that with the described system, where the transfer bias is applied to the belt conductors by multiple contacts, that tailored transfer fields can be generated without requiring any critical "relaxable" or "self leveling" resistance properties of the belt. Likewise, since the resistance material 84 is not in the nip its durometer is not important either. Any suitable plastic, carbon or rubber resistance material may be utilized.

The transfer bias contacts are provided here by six conductive wheels making continuous contact with the strip of resistive material 84 in the transfer station. It will be appreciated that sliding block or other contactors could be used instead. The contactor wheels are in commonly biased pairs at opposite sides of the belt, comprising here a pre-nip wheel pair 86, a nip wheel pair 87, and a post-nip wheel pair 88. Each pair is differently biased to the appropriate level to achieve the electrical transfer field in the transfer region in which it is correspondingly located. The strips of resistive material 84 therebetween smooth the bias level transitions between the individual conductors between each wheel pair, and also between the outside wheel pairs and the adjacent sliding contacts 62 and 64 which are applying the paper tacking biases. Because the transfer bias contactor wheels are provided with a constant voltage level from the common bias source 82, each individual belt conductor is temporarily provided with a constant preset transfer voltage as it passes a given point in the transfer station 24.

This is assisted by the fact that the conductors 13 in the belt are fully insulated at all times from both the copy sheet 18 and the imaging surface 20. Thus, the conductor bias levels are not affected by changes in ambient conditions such as humidity, copy paper, conduction, etc. Likewise, there is no ion flow (discharge) path between the conductors and the other transfer station components.

As previously noted, completely sealing the conductors inside the belt is desirable, so that contaminants will not affect the above-described properties of the system. Although less desirable, it will also be appreciated that spaced multiple corotrons can be used to apply the transfer bias potentials to the belt conductors.

The above-described transfer system utilizing the resistive connecting strips 84 between the conductors 54 provides a constant voltage on each individual conductor transfer system. A constant charge transfer system can be provided if the resistive strips 84 are not present, so that each individual conductor 54 is electrically isolated and is directly sequentially briefly connected to a biased contactor as the belt moves past the contactors. That is, the contactor (especially if it is connected to a constant current power supply) will put a given predetermined charge on each conductor while they are in contact. After the individual conductor disconnects from the contactor the same electrical charge will remain on it, because it is electrically floating and insulated from all of the other conductors and other system elements. This floating charge on the conductor will dissipate slowly due to leakage currents, but at typical belt speeds this leakage will not be significant, so that the charge on each conductor will effectively remain constant until it is deliberately reduced or discharged by subsequent discharge means. The voltage on the individual conductor is a function of both its charge and also the capacitance between that conductor and the imaging surface, (which forms the opposing plate of a capacitor). Thus, with the individual conductor retaining a constant initial charge, as the belt moves on to a different position in which the distance between the same individual conductor and the imaging surface (the transfer gap) is increased, (and/or the dielectric thickness of the intervening copy sheet has increased) the capacitance between the conductor and the imaging surface decreases, which, correspondingly increases the voltage on the individual conductor. This capacitance-controlled change in the voltage on the individual conductors occurs without any change in the initial bias voltage or charge supplied to the conductors and tends to keep the transfer field more constant as the transfer gap increases or decreases. Thus, this provides another desirable system design. It will be noted that with such a constant charge system the initial charge should be put on the conductors at the maximum capacitance region, i.e., in the transfer nip, since a greater charge can be put on the conductors for a given connecting bias voltage in this region and, therefore, a greater transfer field can be provided.

Figure 7:
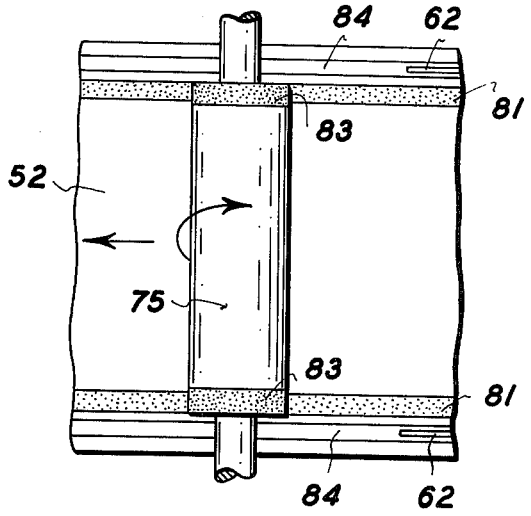
FIG. 7 illustrates the fusing station portion of FIG. 3.

Referring now particularly to FIGS. 3 and 7 and the relationship of the exemplary fuser 68 and the belt 52, the belt runs straight therethrough, carrying the copy sheets on the belt at all times. With this configuration the belt 52 is always interposed between the pressure roll 75 of the fuser and the heated or fuser roll 69. The pressure roll 75 simply engages the back of the belt, transmitting its pressure through the belt. Thus, there is very little opportunity for contamination of the pressure roll, and especially no toner off-setting, since both the paper and the toner are always on the opposite side of the belt from the pressure roll. Thus, no cleaning means are required for the pressure roll.

The fact that new and cool areas of the belt 52 are constantly being interposed between the pressure roll and the fuser roll by the belt movement means that there is no opportunity for any significant heat transfer from the fuser roll to the pressure roll. This allows greater flexibility in the choice of pressure roll materials. There is no significant problem with heat build-up in the belt 52 itself because of its elongated path length. This allows ample opportunity for ambient cooling. However, if desired, particularly in the belt area immediately downstream of the fuser, additional cooling means such as an air blower can be provided. The fact that the conductors in the belt 52 are insulated from contact with the fuser roll by the insulative belt material from the fuser roll into the belt.

To reduce heat transfer from the fuser roll and also to protect the belt 52 both thermally and mechanically, means are preferably provided for protecting the belt 52 from pressure or contact by the fuser elements during any time period in which the belt is not moving. Various camming or latching arrangements may be utilized. (Note U.S. Pat. Nos. 3,754,819 and 3,796,183). This is schematically illustrated here by a solenoid 71 which is actuated to bring the fuser roll 69 up into pressure contact with the belt against the pressure roll only when the belt is moving. Further, conventional timers, sheet sensors or other logic in the machine control can limit the actuation of the solenoid 71 to only time periods when a sheet is in the fusing station.

As shown in FIG. 7, the width of the fuser, particularly the fuser roll 69, is substantially less than the belt 52. Thus, the edges of the belt extend out from the fuser and are not heated significantly. Accordingly, the resistive material and contact areas at the belt edges are not affected by the fuser.

With the arrangement of FIGS. 3–7, the toner image to be fused to the copy sheet 56 is on the side of the sheet opposite from the belt surface. Thus, the fuser heating will not result in any adhesion or off-setting of that toner to the belt. Heat transmitted through the sheet may cause some refusing of toner already on the opposite side of the copy sheet 56 in the case of a duplex copy. However, any toner in contact with the belt will not prevent sheet stripping downstream from the fuser with the appropriate belt materials previously noted. This is assisted here by the fact that there is a substantial section of belt extending downstream from the fuser on which the sheet is transported before it is stripped by a sharply arcuate deflection in the belt path. This section allows the toner to cool, attach more firmly to the sheet, and become less cohesive with the belt surface.

An advantage of the electrostatic sheet tacking systems disclosed herein over sheet tacking systems for fusers which rely on charges externally placed on the copy sheet or belt is that the sheet holding charges are not removed by passage through the fuser, as by grounding contact or ionization with any of the fuser elements. Thus, the copy sheets 56 may continue to be electrostatically retained on the belt even after passage through a directly contacting metal fuser roll. This is desirable here where the belt provides the stripping of the sheet from the fuser roll, and also the toner cooling belt segment on which the copy sheet is carried beyond the fuser.

It may be seen that with the disclosed system and method herein that a copy sheet may be carried in a substantially planar path on a single transport member clear from the input to the output of the entire copying system, without any transfer to another transport member. The belt extends and carries the sheet from one processing station to the other uninterruptedly, while positively retaining the sheet on the belt at all times. This includes the transfer station in which the belt can carry the sheet in and out of intimate transfer contact with the photoreceptor, and the fusing station where the same belt can carry the copy sheet through the nip between a fuser roll and a pressure roll.

The belt 52 can be driven simply by conventional motor drive connected to one or more of the idler rollers supporting the belt. The same drive arrangement may also be utilized, if desired, for directly driving one or both of the rollers of the roll fuser by the belt frictionally driving the rollers. This eliminates the separate drives otherwise required for these rollers and also eliminates problems which can occur due to speed mismatch. It will be noted, however, that since one or both of the fuser roller surfaces and the belt are preferably of a material such as Teflon which has low friction characteristics, that direct drive solely by the movement of the belt through the roller nip may not be sufficient. As illustrated in FIG. 7, one way in which a more positive rotation of the fuser rollers can be provided is by strips 81 or areas of higher friction material adjacent the outer edges of the belt, outside of the fusing area. Corresponding frictional materials may also be provided on end areas 83 of the rollers positioned to continuously engage the strips 81. This provides a more positive frictional drive of the rollers. The areas 83 may, of course, be provided by separate rollers attached to the roller shafts. FIG. 7 illustrates the pressure roll 75 and upper surface of the belt. The fuser roller 69 and the lower surface of the belt 52 may have corresponding strips and end areas.

The belt transfer and fusing system disclosed herein is presently considered to be preferred; however, it is contemplated that further variations and modifications within the purview of those skilled in the art can be made herein. For example, while electrostatic tacking of the sheet to the belt as disclosed is preferred, a porous transfer belt with vacuum sheet holddown may be utilized instead, for example, as taught in the above-cited U.S. Pat. No. 3,647,292.

The following claims are intended to cover all such variations and modifications as fall within the true spirit and scope of the invention.

What is claimed is:

1. In an electrostatographic copying system in which an image of fusable imaging material is formed on an imaging surface and electrostatically transferred at a transfer station to copy sheets and then fused to the copy sheets at a fusing station, wherein the copy sheets are feedable into said copying system from a sheet feeding station and removable at an output station with an image fused thereon, the improvement comprising:

a single endless transporting and supporting belt for transporting said copy sheets in said copying system through both said transfer station and said fusing station, retaining means for retaining said copy sheets on said belt fully supported by said belt from only one side of said copy sheets, said belt extending through said transfer station closely adjacent said imaging surface for said transfer of said fusable imaging material to said copy sheets while said copy sheets are so retained on said belt, said same belt being extended on through said fusing station for fusing of said imaging material on said copy sheets while said copy sheets are so retained on said belt, wherein said retaining means comprises a multiplicity of electrically discrete closely spaced adjacent conductors on said belt forming an extensive pattern over said belt, and biased electrode means for differentially electrically charging adjacent conductors of said supporting belt for generating over said supporting belt a fine charge pattern of alternating closely adjacent differentially charged areas providing copy sheet retaining electrical fringe fields, the spacing of said conductors being sufficiently close so that said image transfer at said transfer station is unaffected by said charge pattern of said electrical fringe fields.

2. The copying system of claim 1 wherein said spacing between said adjacent conductors is not substantially greater than the thickness of said copy sheet.

3. The copying system of claim 1 wherein said spacing between said adjacent conductors is less than approximately 0.13 millimeters.

4. The copying system of claim 1 wherein said conductors are internal said belt and said belt consists essentially of electrically and thermally insulative material.

5. In an electrostatographic copying system in which an image of fusable imaging material is formed on an imaging surface and electrostatically transferred at a transfer station to copy sheets and then fused to the copy sheets at a fusing station, wherein the copy sheets are feedable into said copying system from a sheet feeding station and removable at an output station with an image fused thereon, the improvement comprising:

a single endless transporting and supporting belt for transporting said copy sheets in said copying system through both said transfer station and said fusing station, retaining means for retaining said copy sheets on said belt fully supported by said belt from only one side of said copy sheets, said belt extending through said transfer station closely adjacent said imaging surface for said transfer of said fusable imaging material to said copy sheets while said copy sheets are so retained on said belt, said same belt being extended on through said fusing station for fusing of said imaging material on said copy sheets while said copy sheets are so retained on said belt, wherein said fusing station comprises a fuser roll and an opposable pressure roll, and said belt extends through the nip between said fuser roll and said pressure roll.

6. The copy system of claim 5 wherein said belt extends substantially downstream of said fusing station, prior to said output station, to provide for the cooling of said fused imaging material prior to said removal of said copy sheets from said belt at said output station.

7. The copying system of claim 5 wherein retaining means are electrostatic means for continuously electrostatically retaining said copy sheets on said belt through both said transfer and fusing stations.

8. The copying system of claim 5 wherein said belt extends uninterruptedly from said sheet feeding station to said output station and said copy sheets are retained on said belt at all times in said copying system.

9. The copying system of claim 8 wherein said belt is substantially planar between said sheet feeding station and said output station.

10. The copying system of claim 5 wherein said belt, at said output station, is sharply arcuately deflected to strip copy sheets from said belt.

11. The copying system of claim 5 wherein the same side of said belt faces said imaging surface and said fuser roll and carries said copy sheets.

12. The copying system of claim 11 wherein said same side of said belt is white.

13. The copying system of claim 7 further including cleaning means for cleaning said belt.

14. The copying system of claim 7 wherein said belt is substantially wider than said fusing station to reduce heating of the edges of said belt.

15. The copying system of claim 5 further including means for disengaging said fuser roll from said belt.

16. The copying system of claim 5 further including frictional means for frictionally rotating said rolls by the movement of said belt through said rolls.

17. The copying system of claim 5 wherein said belt extends substantially planarly downstream of said nip to separate said copy sheets from said fusing station.

18. The copying system of claim 17 wherein said belt, at said output station, is sharply arcuately deflected to strip copy sheets from said belt.

19. The copying system of claim 17 wherein the same side of said belt faces said imaging surface and said fuser roll and carries said copy sheets.

* * * * *

Dedication 3,976,370.—*Narendra S. Goel*, Henrietta, and *Gerald M. Fletcher*, Pittford, N.Y. BELT TRANSFER AND FUSING SYSTEM. Patent dated Aug. 24, 1976. Dedication filed Feb. 6, 1978, by the assignee, *Xerox Corporation.*

Hereby dedicates to the Public the remaining term of said patent.

[*Official Gazette April 18, 1978.*]